United States Patent [19]

Hamilton

[11] 4,418,550

[45] Dec. 6, 1983

[54] BOAT LOCKING DEVICE

[76] Inventor: James Hamilton, 189 Upland Rd., Cambridge, Mass. 02140

[21] Appl. No.: 263,139

[22] Filed: May 13, 1981

[51] Int. Cl.[3] ..... E05B 73/00

[52] U.S. Cl. ..... 70/18; 70/2; 292/281

[58] Field of Search ..... 70/2, 3, 4, 5, 6, 7, 70/8, 9, 10, 11, 12, 13, 18, 57, 58, 74; 292/281, 282, 283, 284, 285, 286, 287; 114/126, 127, 230

[56] References Cited

U.S. PATENT DOCUMENTS 3,101,695 8/1963 Honeyman ..... 70/57

4,041,741 8/1977 Cintron ..... 70/417

4,200,944 5/1980 Gillespie ..... 114/230

4,300,793 11/1981 Benzel ..... 292/205

*Primary Examiner*—Robert L. Wolfe

*Attorney, Agent, or Firm*—Wolf, Greenfield & Sacks

[57] ABSTRACT

A device for preventing theft of a small boat having a centerboard slot comprising a plate or rod thin enough to fit through the centerboard slot with means at one end of the plate or rod to which a chain or cable may be secured and means extending outwardly of the rod or plate at the opposite end to keep the device from passing through the centerboard slot.

9 Claims, 10 Drawing Figures

BOAT LOCKING DEVICE

BACKGROUND OF THE INVENTION

Small boats are easily and frequently stolen because there is no commercially acceptable system for effectively locking these boats. Existing anti-theft fittings generally in use today are invariably attached to the exterior of a boat by means of screws or bolts. Such fittings may be easily removed from the boats with the use of ordinary tools. Thus, there is little incentive for a boat owner to purchase such a device.

SUMMARY OF THE INVENTION

The present invention comprises a device for securing a boat with a centerboard slot against theft or any other unauthorized movement. The present invention comprises an elongated member having one end adapted to engagably receive a chain or cable. The other end of the member is provided with means such as a plate, that limits the movement of the elongated member all the way through the centerboard slot.

An object of the present invention is to provide a simple means for securing a boat with a centerboard slot against theft or other unauthorized movement.

Another object of the present invention is to provide a device for securing small boats against theft or other unauthorized movement.

Another object of the present invention is to provide a means for securing a small boat to a stationary object.

Yet another object of the present invention is to provide a boat locking system which may also serve as an anchor when used in association with a small boat.

Further features and characteristics of the present invention can be seen from the figures and descriptions below.

DETAILED DESCRIPTION OF THE INVENTION

The present invention provides means for securing a small sailboat 1 to a fixed object such as a pole 2. Other objects to which the sailboat can be secured include a piling, tree, dwelling, vehicle, trailer or any other relatively large or unmoveable object.

Figure 1:
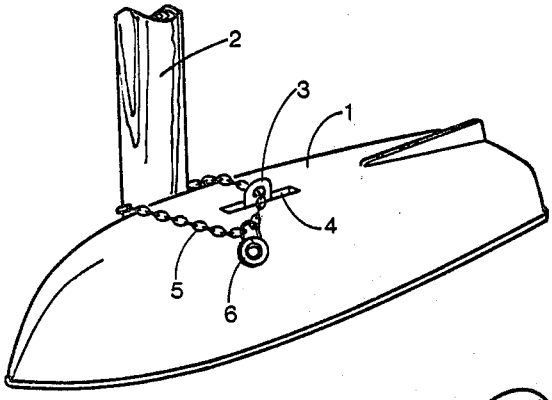
FIG. 1 is a perspective view showing a small sailboat secured to a pole by means of one embodiment of the present invention.
Figure 2:
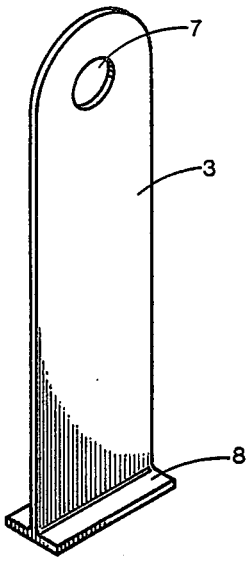
FIG. 2 is a perspective view of the principle component of the embodiment of FIG. 1.

In one embodiment of the present invention, as shown in FIG. 2, a locking member having an elongated flat plate 3 is dimensioned so that it can be passed through the centerboard slot 4 of the sailboat 1. The slot 4 is typically 1" in width and a length that conventionally varies from about one to one and one-half feet. The depth of the slot varies but may be about 1 or 2 feet. The plate 3 is long enough so that its ends can project from opposite ends of slot 4 with the hole 7 projecting beyond the boat. A heavy chain or cable is placed around the pole 2 with one end passed through the hole 7 in plate 3. The free ends of the chain are fastened together with a conventional padlock 6. A rectangular base plate 8, having lateral dimensions greater than the slot 4 is welded to one end of the plate, to prevent the plate 3 from passing all the way through the centerboard slot 4. The embodiment shown in FIGS. 1 and 2 may be made from hardened alloy steel so as to make it very difficult to cut by ordinary means. When the plate 3 is not in use, the lock and chain may be used to keep it secured to the pole 2.

Figure 3:
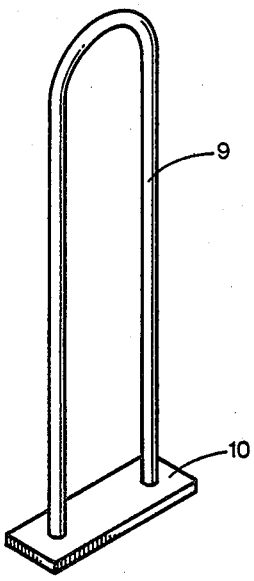
FIG. 3 is a perspective view of a principle component of another embodiment of the present invention.

Another embodiment of the device of the present invention shown in FIG. 3, consists of a U-shaped rod 9 attached to a rectangular base plate 10. The rod 9 is attached to the base plate 10 by any suitable means such as welding or swaging. The diameter of the rod is less than the width of slot 4 and the legs of rod 9 are closer together than the end edges of slot 4. The U-shaped rod is passed through the centerboard slot and the chain or cable is passed between the bent rods as is the case with the previous embodiment. Both the rod and plate are made of an alloy which when hardened is rendered very difficult to cut, saw, or chisel. The rod 9 of FIG. 3 may also be secured when left behind by attaching it to the pole with the chain or cable.

Figure 4:
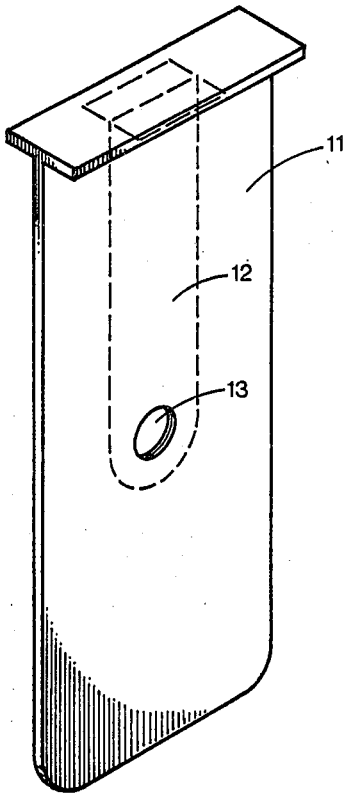
FIG. 4 is a perspective view of a sailboat centerboard incorporating a component of the present invention.

In still another embodiment shown in FIG. 4, means are incorporated into a centerboard 11 for securing a boat with a centerboard slot. In FIG. 4, the dash lines indicate an elongated metal plate 12 that is integral with the centerboard. A hole 13 in the centerboard and the plate is spaced from the upper end of the centerboard a distance greater than the depth of the centerboard slot 4. The chain 5 or a cable may be passed through hole 13 and used to secure the sailboat when not in use. When the sailboat is in use, the centerboard is used in the normal fashion and need not be left behind.

Figure 5:
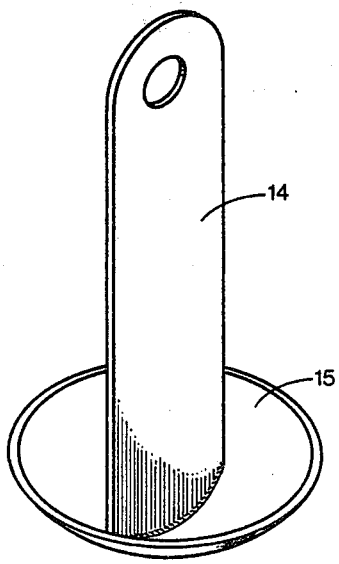
FIG. 5 is a perspective view of an embodiment of the principle component of the present invention suitable for use as an anchor.
Figure 6:
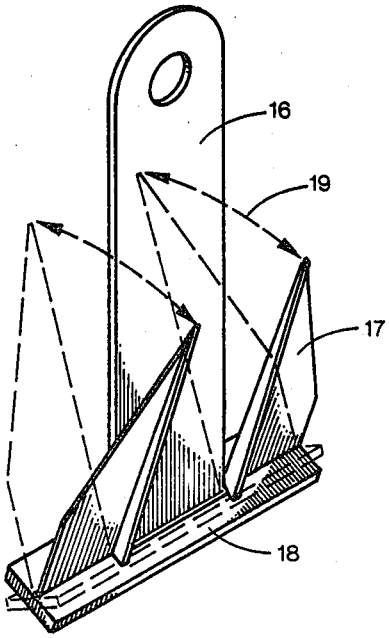
FIG. 6 is a perspective view of an embodiment of the component of FIG. 5, also suitable for use as an anchor.

The two embodiments shown in FIGS. 5 and 6 also serve a dual purpose as does the embodiment shown in FIG. 4. FIG. 5 shows a locking member with a shank 14 which is welded to a concave cap 15. The shank 14 has a thickness and width less than that of slot 4, and a length sufficient to pass through the slot 4. The embodiment shown in FIG. 5 may be used as an anchor when the sailboat is in use.

The embodiment of FIG. 6 consists of a shank 16 which is loosely pivoted to heavy plate 18. A fluke like member 17 may be welded or cast as part of plate 18. This member 17 will travel through a limited arc of rotation as shown by arrows 19. The width of the locking element shown in FIG. 6 must be less than the width of the centerboard slot at the base of the members 17. To use this embodiment as a lock, the members 17 are aligned with shank 16 and passed through centerboard slot 4 when the sailboat is to be secured. The chain 5 is passed through the hole in the shank 17 and around an immoveable object and the ends are locked together with a padlock 6.

Figures 7, 8:
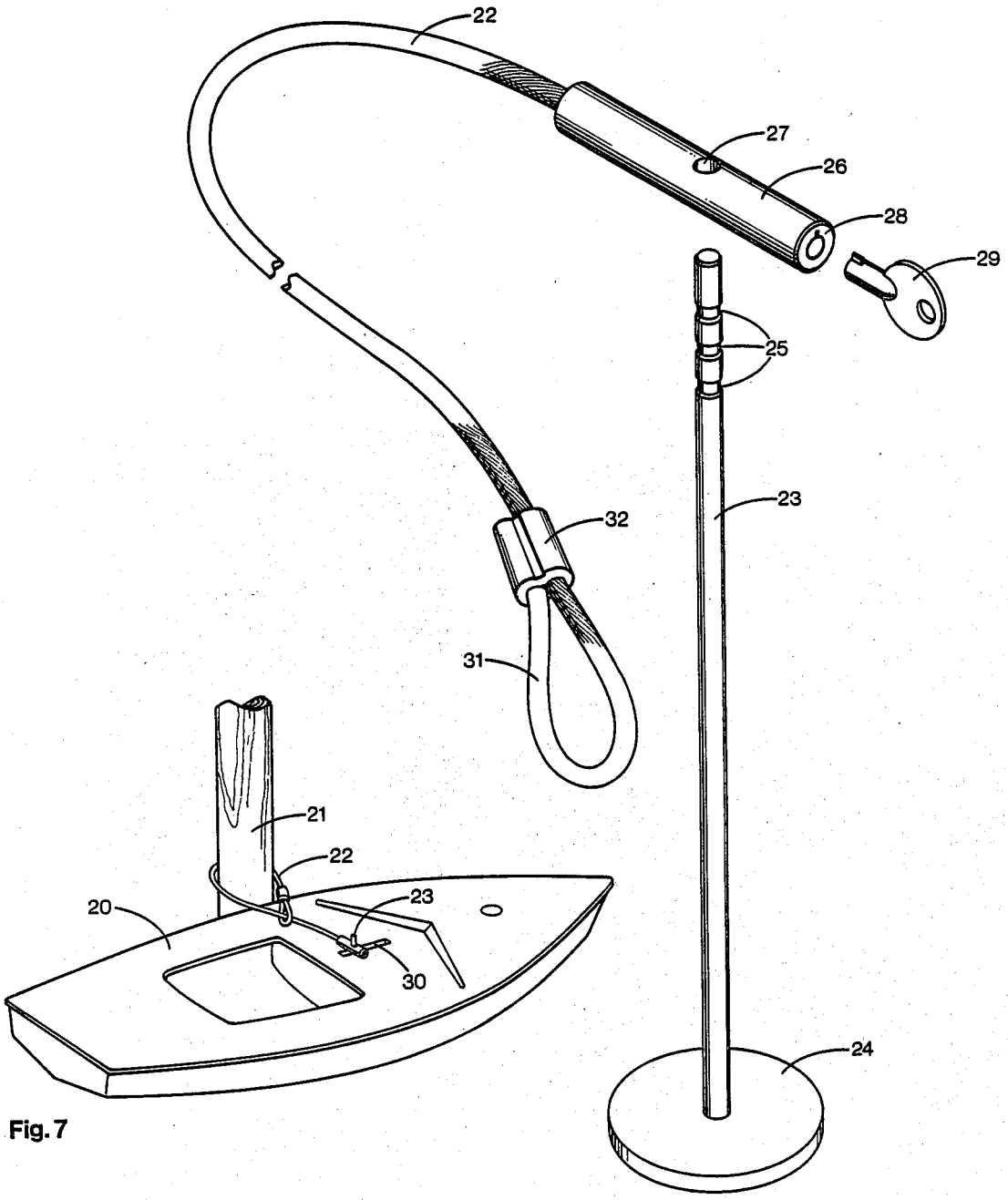
FIG. 7 is a perspective view showing a sailboat secured to a post by means of yet another embodiment of the present invention.
FIG. 8 is a partially exploded view of the embodiment of the present invention represented in FIG. 7.

Another embodiment of the present invention is illustrated in FIGS. 7 and 8 in which a small sailboat 20 with a centerboard slot 30 may be secured to a post 21. In the present embodiment, a cable 22 secures the boat to the post. The locking device of this embodiment consists of a metal shaft 23 welded or otherwise secured to a heavy metal disk 24 at one end and having one or more grooves 25 located at the other end of the shaft as shown in FIG. 8. The disk 24 has a diameter greater than a dimension of slot 4 so that shaft 23 cannot pass entirely through the slot. A cylindrical lock 26 is attached to one end of a cable 22. The lock 26 may engage some of the grooves 25 to be locked onto the end of metal shaft 23 by inserting the end of shaft 23 through hole 27 in cylindrical lock 26 until one of the grooves 25 is aligned with the locking mechanism (not shown) in the lock 26. The cylindrical lock is actuated at one end 28 by means of key 29.

The embodiment shown in FIGS. 7 and 8 is used by positioning shaft 23 through centerboard slot 30. Cable 22 is placed around post 21 passing end 28 through loop 31 and then securing the cylindrical lock 26 to the upper end of shaft 23 which extends out through centerboard slot 30.

Figure 9:
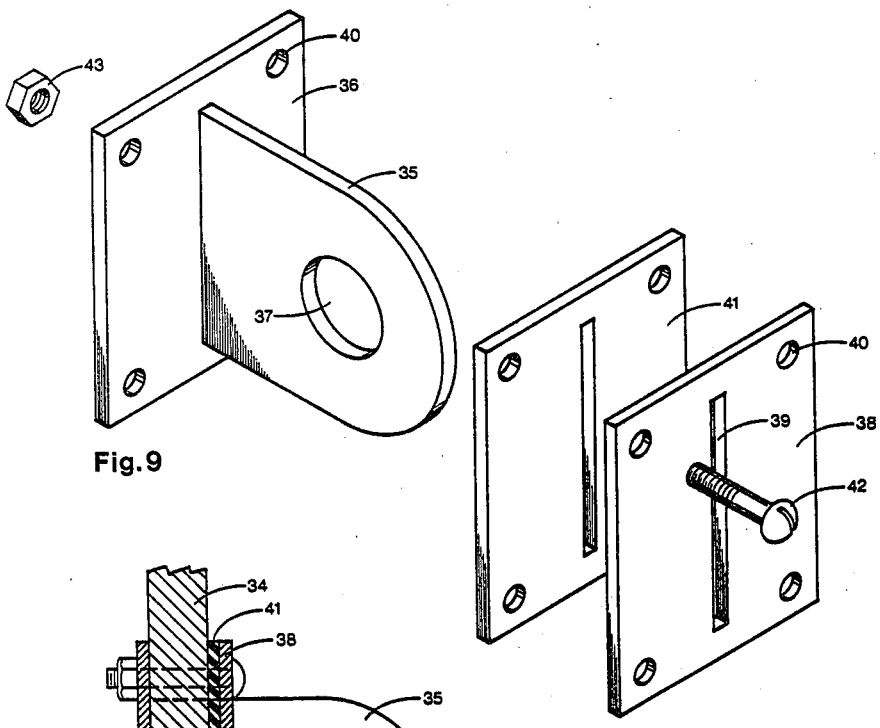
FIG. 9 is an exploded view of yet another embodiment of the present invention.
Figure 10:
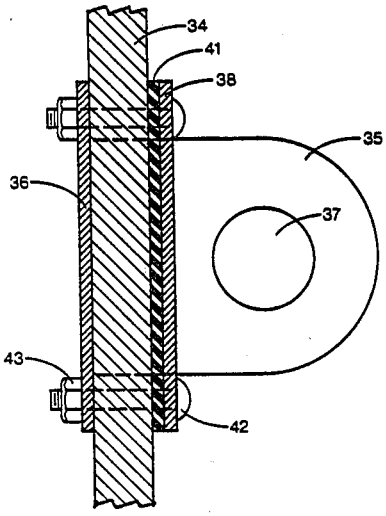
FIG. 10 is a side elevation of FIG. 9 taken from the left hand side of FIG. 9 with the device shown assembled.

The embodiment shown in FIGS. 9 and 10 is intended for use on a boat which does not have a centerboard slot. Examples of these types of boats would be motor boats and sailboats with permanent or swing-type centerboards. This embodiment consists of a T-shaped member comprising a blade 35 securely attached by welding or other means to a flange 36. The blade 35 contains an eye 37 for receiving the end of a chain or cable.

The T-shaped member is installed and secured from the inside of the boat on the transom or deck 34 so as to prevent its removal when the boat is secured by means of a chain or cable and lock. The blade is projected through a slot cut in the transom 34. Slot 39 of pressure plate 38 is placed over blade 35 after gasket 41 is positioned over the blade. Holes 40 in the gasket, blade plate and transom are aligned when the device is assembled and bolts 42 are placed therethrough and secured by means of nuts 43. The openings in gasket 41 are tight fitting to blade 35 and provide a water tight seal when secured by bolts and nuts 42, 43.

One or more of the fittings of the last embodiment may be installed on the stern transom of a boat such as a motor boat to provide the means to lock the outboard motor to the boat and the boat to a relatively stationary or large object such as a tree or trailer. Since the device is secured from the inside of the vessel, the only way to remove it is to substantially destroy the structure of the boat around the fitting. This would sufficiently deter the majority of people wanting to use the boat without permission.

The foregoing description of the invention is intended merely to be illustrative. Other modifications and embodiments of the invention may be apparent to those skilled in the arts.

Having described the invention, I claim:

1. A locking system for securing a boat having a centerboard slot against theft or unauthorized movement comprising:

a metal locking member having an elongated portion shaped and sized to project through said slot with each end of said portion extending beyond the ends of said slot, one end of said portion having means extending outwardly a distance greater than at least one dimension of said slot to prevent movement of said elongated portion entirely through said slot, means forming an opening at the other end of said portion through which a cable may be secured, and an elongated cable extending through said opening with means for securing said cable in a loop, about an immoveable object and to said locking member.

2. A locking system as set forth in claim 1 wherein said elongated portion comprises a flat metal plate, said means extending outwardly comprises a flange integrally formed with said plate and extending laterally of opposite sides of said plate, and said opening is located in said plate at a distance from said flange greater than the depth of said slot.

3. A locking system set forth in claim 1 wherein said elongated portion comprises an elongated U-shaped rod, said means extending outwardly comprises a flange secured to the free ends of said rod and extending laterally from the plane in which said U-shaped rod lies, said U-shaped rod having a length greater than the depth of said slot.

4. A locking system as set forth in claim 2 wherein said elongated portion forms a portion of the keel part of a removeable non-metal centerboard.

5. A locking system as set forth in claim 2 wherein said flange is cup-shaped whereby said locking system may function as an anchor.

6. A locking system as set forth in claim 2 having means for pivotally securing said flange to an end of said elongated portion, and a pair of fluke-like members integrally formed with said flange with one on either side and extending in the direction of said elongated portion whereby said locking system may function as an anchor having moveable flukes.

7. A locking system for securing a boat having a centerboard slot against theft or unauthorized movement comprising:

a metal locking member having an elongated portion shaped and sized to project through said slot with each end of said portion extending beyond the ends of said slot, one end of said portion having means extending outwardly a distance greater than at least one dimension of said slot to prevent movement of said elongated portion entirely through said slot, means forming an opening at the other end of said portion through which a cable may be secured, and an elongated cable having means at one end being secured to an immoveable object and means at the other end for being secured to the end that is remote from said means extending outwardly.

8. A locking system as set forth in claim 7 wherein said cable is formed with a loop at said one end and a lock adapted to be locked to said elongated portion at the other end.

9. A locking system for small craft comprising:

a t-shaped locking member with a blade having a hole therein and a flange integrally formed with said blade at an end remote from said hole, said t-shaped locking member secured to a boat transom or the like with said blade projecting through a slot in said transom with the flange on the inside and the hole on the outside of said transon and a retaining means comprising a metal plate with a slot to receive said blade forming the outer member of a sandwich of said flange, transom and plate, and bolt means securing said sandwich together, and a lockable chain for interengaging said t-shaped locking member through said hole with an immoveable object.

* * * * *